US010443595B2

(12) United States Patent
Avireddi et al.

(10) Patent No.: US 10,443,595 B2
(45) Date of Patent: Oct. 15, 2019

(54) AUTOMOTIVE FUEL PUMP

(71) Applicant: Hitachi, Ltd, Tokyo (JP)

(72) Inventors: Prashanth Avireddi, Farmington Hills, MI (US); Nikhil Seera, Farmington Hills, MI (US); Akira Inoue, Farmington Hills, MI (US)

(73) Assignee: Hitachi, Ltd., Tokyo (JP)

( * ) Notice: Subject to any disclaimer, the term of this patent is extended or adjusted under 35 U.S.C. 154(b) by 653 days.

(21) Appl. No.: 14/690,940

(22) Filed: Apr. 20, 2015

(65) Prior Publication Data

US 2016/0305384 A1 Oct. 20, 2016

(51) Int. Cl.

| | |
|---|---|
| ***F04B 53/16*** | (2006.01) |
| ***F04B 7/00*** | (2006.01) |
| ***F02M 59/46*** | (2006.01) |
| ***F02M 59/10*** | (2006.01) |
| ***F02M 59/44*** | (2006.01) |

(Continued)

(52) U.S. Cl.

CPC ..... *F04B 53/16* (2013.01); *F02M 59/102* (2013.01); *F02M 59/44* (2013.01); *F02M 59/462* (2013.01); *F02M 59/464* (2013.01); *F04B 1/0404* (2013.01); *F04B 7/0076* (2013.01); *F04B 11/0091* (2013.01)

(58) Field of Classification Search

CPC .. F04B 1/0404; F04B 7/0076; F04B 11/0091; F04B 39/0027; F04B 39/0033; F04B 39/0038; F04B 53/16; F02M 59/44; F02M 59/462; F02M 59/102; F04F 5/00; F04F 5/02; F04F 5/10; F04F 5/12; F04F 5/44; F04F 5/46; F04F 5/467

See application file for complete search history.

(56) References Cited

U.S. PATENT DOCUMENTS 1,611,475 A * 12/1926 Maxim ..... F01N 1/003 165/174

2,774,374 A 12/1956 Schneider (Continued)

FOREIGN PATENT DOCUMENTS

EP 2385241 A1 11/2011

JP 2001-207938 A 8/2001

(Continued)

OTHER PUBLICATIONS

Japanese Office Action received in corresponding Japanese Application No. 2016-076277 dated Feb. 21, 2017.

*Primary Examiner* — Bryan M Lettman

*Assistant Examiner* — Charles W Nichols

(74) *Attorney, Agent, or Firm* — Mattingly & Malur, PC

(57) ABSTRACT

A fuel pump having a housing defining a pump chamber and an inlet and outlet fluidly connected to the pump chamber. A one way check valve is disposed fluidly in series between the pump chamber and the outlet and is oriented to allow fluid flow from the pump chamber and to the outlet when the check valve is open. A venturi tube is fluidly connected in series between the pump chamber and the outlet which effectively dampens noise pulsations. An inlet valve to the pump chamber has an anchor attached to a valve member and the stationary core. A conical surface on the core abuts against a complementary conical surface on the anchor when the valve is either in its fully open or fully closed position.

12 Claims, 3 Drawing Sheets

(51) Int. Cl.
*F04B 1/04* (2006.01)
*F04B 11/00* (2006.01)

(56) References Cited

U.S. PATENT DOCUMENTS

| | | | | |
|---|---|---|---|---|
| 4,706,705 | A * | 11/1987 | Lee, II | F16K 15/044 137/454.2 |
| 6,079,450 | A | 6/2000 | Onishi et al. | |
| 6,789,529 | B2 | 9/2004 | Suzuki et al. | |
| 7,677,872 | B2 | 3/2010 | Beardmore | |
| 7,827,967 | B2 | 11/2010 | Beardmore | |
| 8,561,598 | B2 * | 10/2013 | McAlister | F02M 51/0671 123/490 |
| 2013/0280112 | A1 * | 10/2013 | Usui | F02M 63/005 417/540 |
| 2013/0333672 | A1 | 12/2013 | Ryoo | |

FOREIGN PATENT DOCUMENTS

| | | | |
|---|---|---|---|
| JP | 2002-250258 | A | 9/2002 |
| JP | 2004-116526 | A | 4/2004 |

* cited by examiner

AUTOMOTIVE FUEL PUMP

BACKGROUND OF THE INVENTION

I. Field of the Invention

The present invention relates generally to fuel pumps and, more particularly, to a fuel pump for a direct injection spark ignition engine.

II. Description of Related Art

Many modern automotive vehicles utilize a direct injection internal combustion engine in which the fuel is injected directly into the combustion chamber by a fuel injector rather than upstream from the intake valves to the combustion chamber. Since the fuel is injected directly into the combustion chamber, the direct injection engines enjoy a higher efficiency and better fuel economy than other types of internal combustion engines.

Since fuel is injected directly into the engine cylinders or combustion chambers, the fuel supply must necessarily be provided at a high pressure sufficient to overcome the pressures existing within the interior of the combustion chambers. Typically, a fuel pump supplies fuel from a source of fuel, such as a fuel tank, to a high pressure fuel injection rail. The fuel injection rail is then fluidly connected to the individual fuel injectors that are mounted on the engine block. The opening and closing timing for each of the fuel injectors for the engine is then controlled by an electronic control system for the vehicle.

The previously known fuel pumps for the spark ignition by direct injection (SIDI) engines typically included a housing having both a fluid inlet connected to the fuel tank and an outlet connected to the fuel injection rail. A plunger is then reciprocally driven by a cam in synchronism with the engine in a pump chamber within the interior of the housing between the inlet and the outlet.

In order to control the fuel flow from the pump inlet to the outlet, the fuel pump includes an inlet valve which is conventionally driven between an open and a closed position by a solenoid. A one way check valve is then positioned within the outlet to permit fuel flow from the pump chamber and through the outlet to the fuel rail.

In operation, the inlet valve is opened and closed by energization of the solenoid. When the plunger is retracted from the pump chamber, the inlet valve is opened by the solenoid thus allowing the plunger to induct fuel from the fuel tank into the pump chamber. Conversely, as the plunger is extended or driven into the pump chamber, the inlet valve is closed so that the fuel pressurized by the inward movement of the plunger opens the outlet valve and pumps the pressurized fuel through the one way outlet valve and into the pressure rail.

One disadvantage of these previously known SIDI fuel pumps, however, is that the overall fuel system is quite noisy in operation, especially at low engine speeds. The noise from the fuel system is undesirable for the comfort of the occupants of the vehicle.

Although there are many sources of noise in the fuel system for a SIDI engine, one major cause of engine noise results from the fuel pulsations caused by the reciprocating plunger in the overall fuel system. These fuel pump pulsations occur not only in the fuel pump, but also through the remainder of the fuel system including the fuel rails.

A second major source of noise for the SIDI engines is attributable to noise from the opening and closure of the inlet valve for the fuel pump. The opening and/or closure of the inlet valve causes an anchor in the solenoid valve to impact against a stationary core in the solenoid valve. This impact between the anchor and the core causes a clicking sound which is particularly audible at low engine speeds.

SUMMARY OF THE PRESENT INVENTION

The present invention provides an automotive fuel pump for a SIDI engine which overcomes the previously known disadvantages of the previously known fuel pumps.

In brief, the SIDI fuel pump of the present invention includes a housing having a pump chamber and with both an inlet and an outlet fluidly connected to the pump chamber. A one way check valve is fluidly disposed between the pump chamber and the outlet and forms the outlet valve for the pump. The outlet valve is oriented to allow fluid flow from the pump chamber, through the outlet valve, and to the fuel rails, but not vice versa.

In order to dampen fuel pulsations within the fuel system, not only the fuel pump itself, but also the other components of the fuel system, such as the fuel rail, at least one venturi tube is fluidly connected in series between the pump chamber and the fuel pump outlet. This venturi tube may be positioned upstream from the outlet valve, downstream from the outlet valve, or both. Furthermore, the venturi tube may have multiple constriction points along its length to provide for a multiple venturi effect.

In practice, since automotive fuel is essentially incompressible (fuel has low compressibility), as the fuel is pumped through the restriction in the venturi tube, the velocity of the fuel through the restriction or throat increases thus increasing the kinetic energy of the fuel flow while decreasing the pressure. This in effect acts as a choke to dampen the vibrations caused by reciprocation of the fuel plunger in the pump chamber.

The SIDI fuel pump of the present invention also includes an inlet valve which is actuated between an open and a closed position by a solenoid. The solenoid includes a stationary core while the valve member is mounted on an elongated anchor and movable in unison with the valve member.

Actuation of the solenoid moves the anchor together with the valve member between a fully extended position and a fully retracted position so that the valve is either in a fully open position, or fully closed position, or vice versa. However, when the valve member is in its fully retracted position, the anchor impacts upon the stationary core of the solenoid. Unlike the previously known SIDI fuel pumps, however, when the anchor, and thus the valve member, are in their fully retracted position, a conical surface on the core impacts against a complementary conical surface on the anchor. Thus, unlike the previously known SIDI fuel pumps, the impact force is dispersed partially in a radial direction thus reducing the noise output from the input valve of the pump.

BRIEF DESCRIPTION OF THE DRAWING

A better understanding of the present invention will be had upon reference to the following detailed description when read in conjunction with the accompanying drawing, wherein like reference numbers refer to like parts throughout the several views, and in which.

DETAILED DESCRIPTION OF A PREFERRED EMBODIMENT OF THE INVENTION

Figure 1:
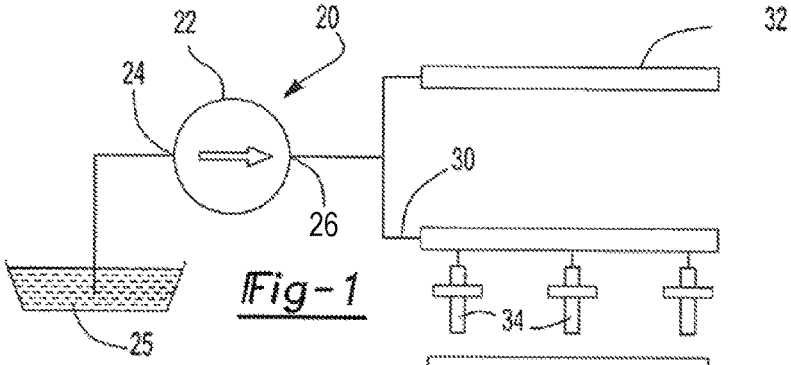
FIG. 1 is a schematic view illustrating a fuel system for a SIDI engine.
Figure 2:
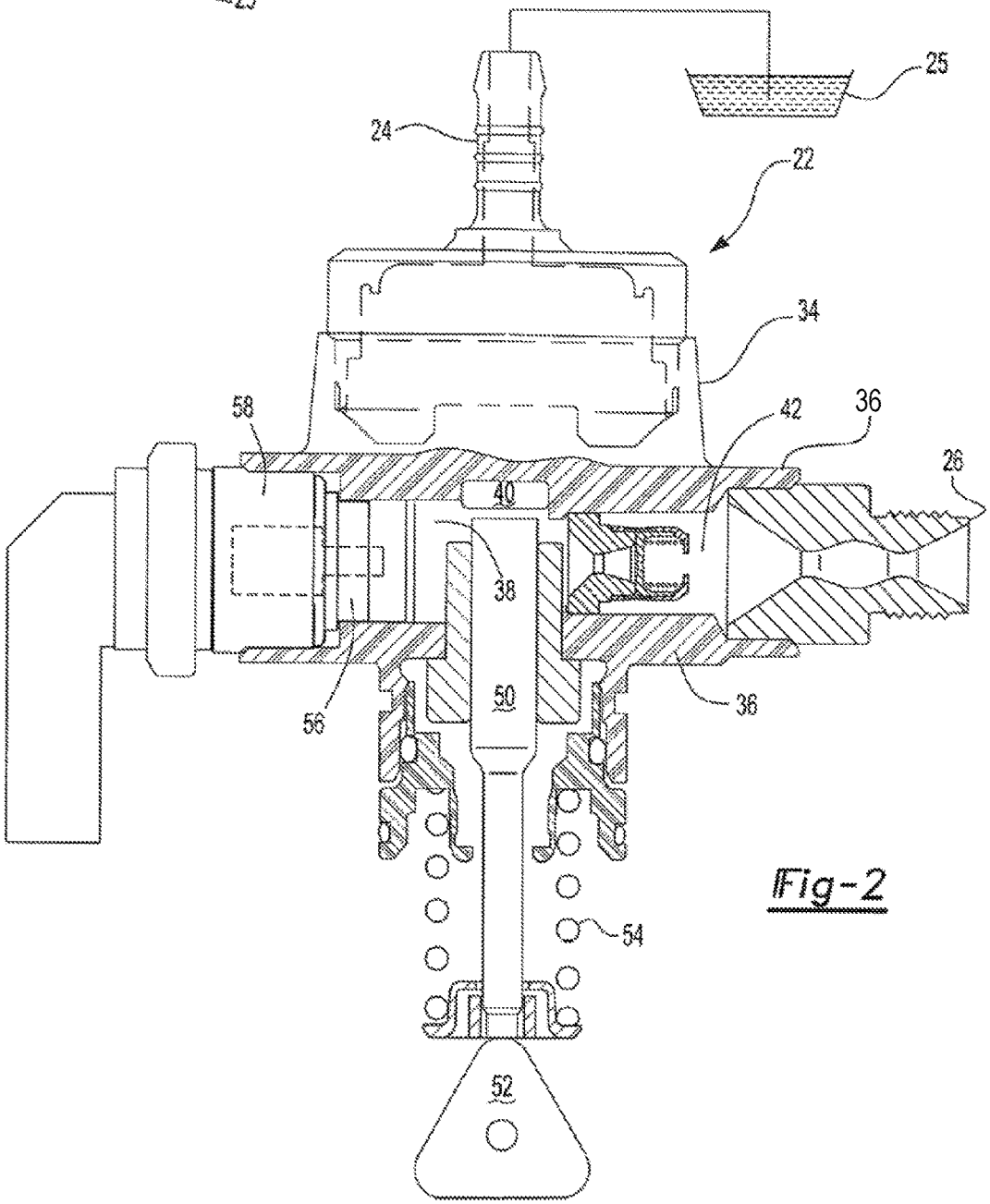
FIG. 2 is a sectional view of a fuel pump.

With reference first to FIGS. 1 and 2, a diagrammatic view of a fuel system 20 for a SIDI engine (not shown) is illustrated diagrammatically. The fuel system includes a fuel pump 22 having a housing 36 and an inlet 24 fluidly connected to a fuel source 25, such as a fuel tank. An outlet 26 from the fuel pump 22 is then connected by fuel supply lines 30 to one or more fuel rails 32. The fuel rails 32 are then fluidly connected to a plurality of fuel injectors 34 which inject fuel directly into the combustion chamber for the engine. Typically, one fuel injector 34 is associated with each combustion chamber.

With reference now to FIG. 2, the fuel pump 22 is there shown in greater detail and includes a housing 36 made of any conventional rigid material, such as steel. A fluid passageway 38 extends through the housing 36 between the inlet 24 and outlet 26 and includes a pump chamber 40 along its length.

Still referring to FIG. 2, a one way outlet check valve 42 is fluidly connected in series with the fluid passageway 38 between the pump chamber 40 and the outlet 26. This outlet valve 42, better shown in FIG. 3, includes a valve member 44 which is urged towards a closed position against its valve seat 46 by a spring 48. Consequently, when the pressure within the pump chamber 40 exceeds a predetermined threshold sufficient to overcome the force of the spring 48, the outlet valve 42 moves to an open position in which the spring 48 is compressed and the valve member 44 is displaced away from its valve seat 46. In this position, fluid is able to flow from the pump chamber 40 and to the outlet 26.

Conversely, when the pressure in the pump chamber falls below the predetermined threshold, the spring 48 moves the valve member 44 against the valve seat 46 and thus moves the outlet valve 42 to a closed position. In its closed position, the outlet valve 42 prevents fluid flow from the outlet 26 back into the pump chamber 40.

Referring again to FIG. 2, in order to produce the pressurized fuel in the pump chamber 40, an elongated plunger 50 is reciprocally mounted within the housing 36 and is reciprocally driven by a cam 52 in turn driven by the engine and thus in synchronism with the engine. Furthermore, upon rotation of the cam 52, the cam 52 reciprocally drives the piston 50 in the pump chamber 40 against the force of a plunger spring 54.

Still referring to FIG. 2, fluid flow from the pump inlet 24 and into the pump chamber 40 is controlled by an inlet valve 56. The inlet valve 56, which will subsequently be described in greater detail, is movable by a solenoid 58 between an open and a closed position. In its open position, the inlet valve 56 allows fuel to freely flow from the fuel source 25 and the fuel inlet 24 and into the pump chamber 40. Conversely, when the inlet valve 56 is in its closed position, fluid flow from the pump chamber 40 back to the inlet 24 is precluded.

In operation, as the plunger 50 is retracted from the pump chamber 40 by the force of the spring 54, the inlet valve 56 is in an open position thus allowing the plunger 50 to induct fuel from the fuel source 25 through the fuel inlet 24 and into the pump chamber 40. Conversely, when the plunger is thereafter extended or driven into the pump chamber 40 by the rotating cam 52, the inlet valve 56 is moved to its closed position so that the inward travel of the plunger 50 into the pump chamber 40 increases the fuel pressure in the pump chamber 40. This increased fuel pressure overcomes the force of the outlet valve spring 48 causing the outlet valve 42 to open. Upon opening of the outlet valve 42, fluid flows from the pump chamber 40 through the valve 42 and out through the outlet 26.

Consequently, the reciprocation of the plunger 50 occurs once for each lobe of the cam 52 during each revolution of the cam 52. It is these pressure pulsations of the fuel pump 22 which form a major source of noise from the fuel system 20 (FIG. 1) for a SIDI engine.

Figure 3:
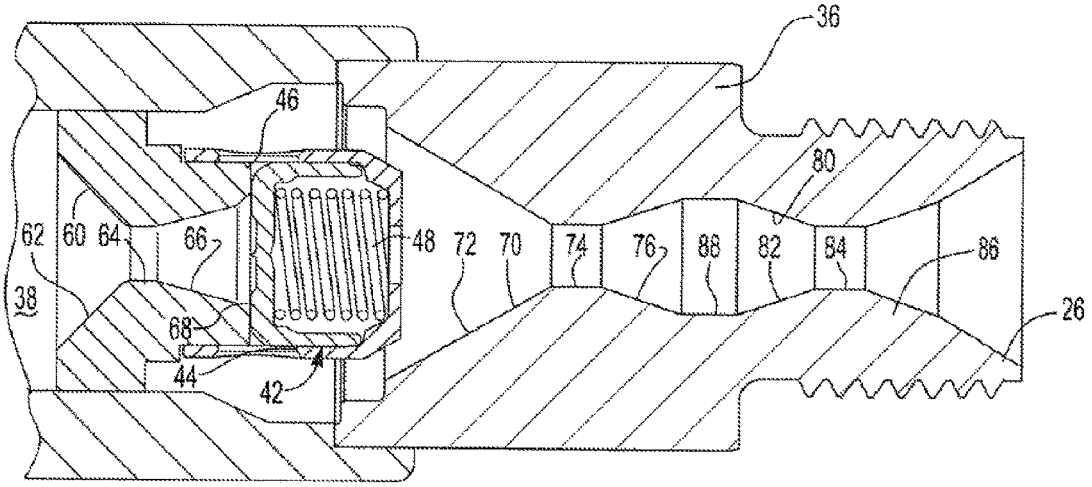
FIG. 3 is a sectional view of the outlet valve and venturi tubes.

With reference now particularly to FIG. 3, in order to reduce the pressure pulsations in the overall fuel system 20, a venturi tube 60 is fluidly connected in series with the fuel passageway 38 through the housing 36. This venturi tube 60 includes a convergent section 62, a restricted diameter throat 64, and a divergent section 66 in series with each other. The divergent section 66 ends in a fluid port 68 formed by the valve seat 46 for the outlet valve 42.

In operation, since automotive fuel is essentially incompressible (fuel has low compressibility), the fluid flow through the venturi tube 60 increases the speed of the fuel flow through the restricted diameter throat 64. This in turn effectively increases the kinetic energy of the fuel flow which simultaneously reduces the pressure as the flow exits through the venturi tube 60. By reducing the fluid pressure, the fluid pressure pulsations in the fuel system 20, and thus any noise occurring because of those pressure pulsations, is dampened.

Still referring to FIG. 3, in addition to the venturi tube 60, or in lieu of the venturi tube 60, a first outlet venturi 70 is either formed in the housing 36, or attached to the housing 36, immediately downstream from the outlet valve 42. This venturi tube 70 includes a convergent section 72, restricted diameter throat 74, and divergent section 76. In the same fashion as the first venturi tube 60, the outlet venturi tube 70 increases the kinetic energy of fluid flow passing through the pump outlet 26 which simultaneously decreases the pressure and thus the pressure pulsations within the fuel system 20.

Optionally, a second outlet venturi tube 80 is also connected in series with the first outlet venturi tube 70. The second outlet venturi tube 80 also includes a convergent section 82, restricted diameter throat 84, and divergent section 86. The inlet to the first convergent section 82 of the second outlet venturi tube 80 is connected to the outlet from the divergent section 76 of the first outlet venturi 70 by a short cylindrical section 88.

The second outlet venturi 80 operates in the same fashion as the first outlet venturi 70, i.e. the second outlet venturi 80 increases the kinetic energy of the fuel flow out through the pump outlet 26 which simultaneously decreases the pressure. By reducing the pressure, the pressure pulsations throughout the fuel system 20 are reduced.

Figure 4A:
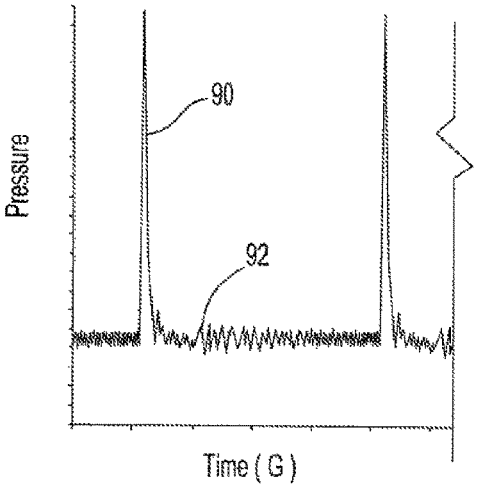
Fig-4A PRIOR ART
FIG. 4A is a graph illustrating pressure pulsations in a prior art fuel system.

FIG. 4A represents the pressure at the outlet 26 for two pumping cycles for a SIDI pump without any of the venturi tubes. As can be seen, multiple pressure pulsations 92 follow each pumping stroke 90 and it is these pulsations 92 which create fuel system noise.

Figure 4B:
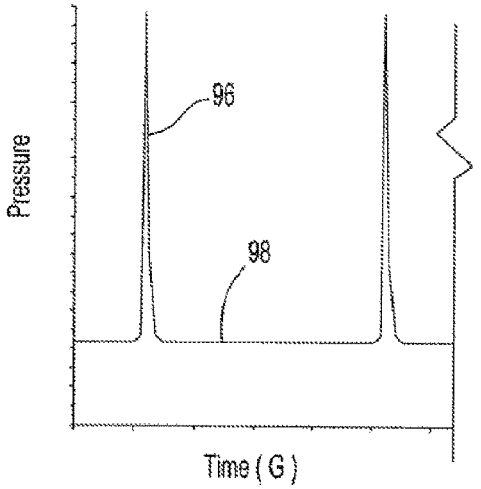
FIG. 4B is a graph illustrating dampened pressure pulsations in the fuel system.

FIG. 4B represents the pressure at the outlet 26 for two pumping cycles for a SIDI pump with one or more of the venturi tubes 60, 70, and 80. As can be seen, any pressure pulsations 98 after each pumping stroke 96 are substantially dampened thus reducing fuel system noise.

Figure 5:
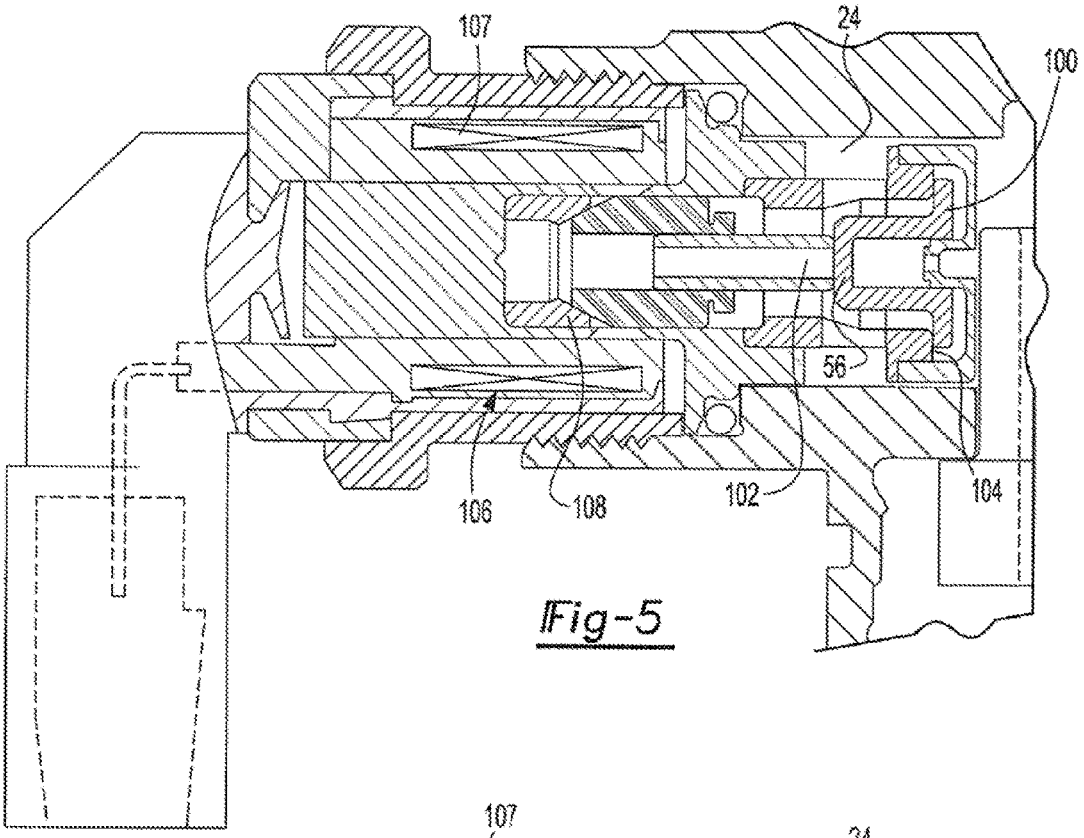
FIG. 5 is a sectional view illustrating a portion of the inlet valve and actuating mechanism with the valve in a closed position.

With reference now to FIG. 5, a still further enhancement of the SIDI pump 22 of the present invention resides in the design of the inlet valve 56 and its actuating mechanism. The inlet valve 56 includes a valve member 100 which is attached to an elongated anchor 102. The anchor 102, together with the valve, is movable between a closed position, illustrated in FIG. 5, and an open position, illustrated in FIG. 6. In its closed position, the valve member 100 cooperates with its valve seat 104 thus closing the fuel inlet 24 from the pump chamber. The inlet valve 100 is closed, for example, during the pumping or inward stroke of the plunger 50 (FIG. 2).

Conversely, in its open position, the valve member 100 is shifted away from its valve seat 104 thus opening the inlet port. With the inlet port open, fuel may be inducted in through the pump inlet 24 and into the pump chamber 40. The inlet valve 100 is open during at least a portion of the plunger retraction or suction cycle of the plunger 50.

Figure 6:
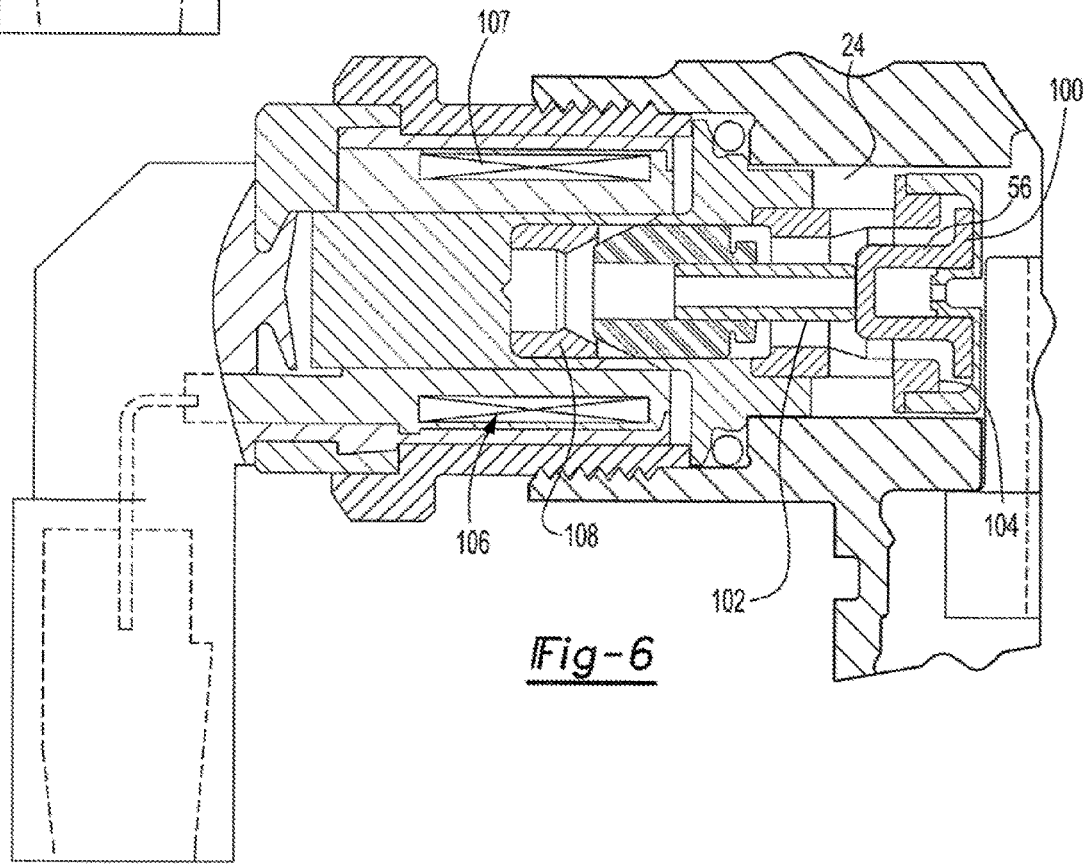
FIG. 6 is a view similar to FIG. 5 but illustrating the valve in an open position.

Still referring to FIGS. 5 and 6, a solenoid 106 is actuated or energized to move the anchor 102 with its attached valve member 100 between its open and closed positions. The solenoid 106 includes solenoid coils 107 which cooperate with a magnetic core 108 to generate the magnetic flux necessary to magnetically displace the anchor 102 with its attached valve member 100.

Figure 7:
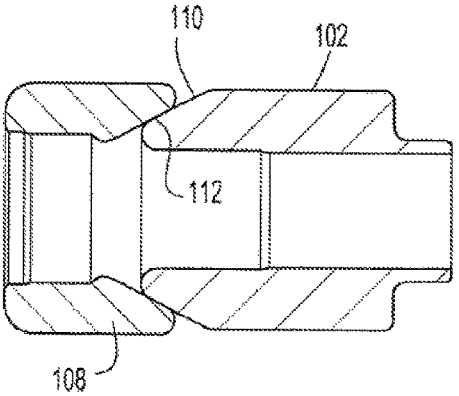
FIG. 7 is a view of the core and anchor with other components removed for clarity.

With reference now to FIG. 7, the anchor 102 and core 108 abut against each other when the anchor 102 is in its fully retracted position. With the anchor in its fully retracted position, the inlet valve 100 is either in its fully open or fully closed position.

Unlike the previously known anchors and cores, however, the anchor 102 includes an outside conical surface or frusto-conical surface 110 which abuts against an inner conical or frusto-conical surface 112 on the core 108. Consequently, as the anchor surface 110 impacts against the core surface 112, the force of the impact is dispersed at least partially in a radial direction which simultaneously consumes a portion of the energy of the impact and causes a slight radial enlargement of the core 108. However, by dissipating at least a portion of the energy of the contact between the anchor 102 and the core 108 into a radial expansion of the core, any sound caused by the impact of the anchor surface 110 and core surface 112 is dampened.

Figure 8:
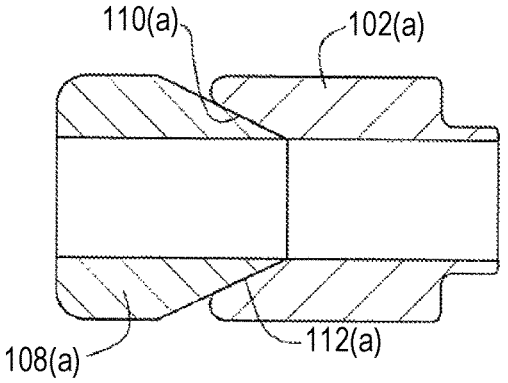
FIG. 8 is a view similar to FIG. 7, but illustrating a modification thereof.

With reference now to FIG. 8, a modified anchor 102(*a*) and modified core 108(*a*) is shown in which the outer conical surface 112(*a*) is formed on the core 108(*a*), rather than the anchor 102(*a*), while an inner conical surface 110(*a*) is formed on the anchor 102(*a*), rather than the core 108(*a*). In this case, as the anchor surface 110(*a*) contacts the core surface 112(*a*), the anchor 102(*a*), rather than the core 108(*a*), expands slightly in the radial direction thus absorbing energy and reducing sound as previously described.

From the foregoing, it can be seen that the present invention provides an improved SIDI pump design which effectively reduces pressure pulsations and other noise within the overall fuel system 20. Having described our invention, however, many modifications thereto will become apparent to those skilled in the art to which it pertains without deviation from the spirit of the invention as defined by the scope of the appended claims.

We claim:

1. A fuel pump comprising:

a housing having a pump chamber, an inlet and outlet fluidly connected to said pump chamber;

a one way check valve disposed fluidly in series between said pump chamber and said outlet and oriented to allow fluid flow of a fluid from said pump chamber to said outlet when said check valve is in an open position;

a first venturi tube fluidly connected in series with said pump chamber and said check valve;

a second venturi tube fluidly connected in series with said first venturi tube and said outlet, wherein the first venturi tube and the second venturi tube are fluidly positioned downstream from the check valve, the fluid flow from the pump chamber passing in series through the first venturi tube and the second venturi tube to the outlet; and a third venturi tube including a frusto-conical convergent section opening to the pump chamber and connected to a frusto-conical divergent section by a throat, wherein an inlet diameter of the frusto-conical convergent section of the third venturi tube opening to the pump chamber is greater than an outlet diameter of the frusto-conical divergent section of the third venturi tube adjacent to the check valve, wherein the third venturi tube dampens pressure pulsations in the fluid;

an inlet valve movable between an open position in which fluid flow through the inlet and into the pump chamber is permitted, and a closed position in which fluid flow between the inlet and the pump chamber is prevented, the valve having a valve member which cooperates with a valve seat in the housing;

an anchor attached to and linearly movable in unison with the valve member; and an actuator that linearly displaces the valve member and anchor to actuate the valve between the open and the closed positions, wherein:

a surface on the anchor contacts a surface on the core when the valve is in one of the open or closed positions, and the surfaces on the core and the anchor are complementary and conical in shape such that when the surface on the anchor contacts the surface on the core, a conical outer surface on one of the anchor or the core contacts a complimentary conical inner surface on the other of the anchor or the core.

2. The fuel pump as defined in claim 1 wherein each of the first venturi tube and the second venturi tube comprises a convergent section and a divergent section, and wherein the divergent section of said first venturi tube is upstream from said convergent section of said second venturi tube.

3. The fuel pump as defined in claim 2 wherein each of the first venturi tube and the second venturi tube comprises a cylindrical throat connecting its respective convergent and divergent section.

4. The fuel pump as defined in claim 2 further comprising a cylindrical passageway disposed in series between the divergent section of said first venturi tube and said convergent section of said second venturi tube.

5. The fuel pump as defined in claim 1 wherein said first venturi tube and the second venture tube are formed as a passageway in said housing having one end open to the outlet and another end receiving the fluid flow from the check valve.

6. A fuel pump comprising:

a housing including a pump chamber;

an inlet fluidly connected to the pump chamber;

an outlet fluidly connected to the pump chamber;

a one way check valve disposed between the pump chamber and the outlet and oriented to allow fluid flow from the pump chamber to the outlet when the check valve is in an open position;

a first venturi tube fluidly connected in series downstream from the check valve;

a second venturi tube fluidly connected in series downstream from the first venturi tube and upstream of the outlet, wherein the fluid flow from the pump chamber passes in series through the check valve, the first venturi tube, and the second venturi tube to the outlet; and a third venturi tube including a frusto-conical convergent section opening to the pump chamber and connected to a frusto-conical divergent section by a throat, wherein an inlet diameter of the frusto-conical convergent section of the third venturi tube opening to the pump chamber is greater than an outlet diameter of the frusto-conical divergent section of the third venturi tube adjacent to the check valve, wherein the third venturi tube dampens pressure pulsations in the fluid;

an inlet valve movable between an open position in which fluid flow through the inlet and into the pump chamber is permitted, and a closed position in which fluid flow between the inlet and the pump chamber is prevented, the valve having a valve member which cooperates with a valve seat in the housing;

an anchor attached to and linearly movable in unison with the valve member; and an actuator that linearly displaces the valve member and anchor to actuate the valve between the open and the closed positions, wherein:

a surface on the anchor contacts a surface on the core when the valve is in one of the open or closed positions, and the surfaces on the core and the anchor are complementary and conical in shape such that when the surface on the anchor contacts the surface on the core, a conical outer surface on one of the anchor or the core contacts a complimentary conical inner surface on the other of the anchor or the core.

7. The fuel pump as defined in claim 6 wherein each of the first venturi tube and the second venturi tube comprises a convergent section and a divergent section, and wherein the divergent section of the first venturi tube is upstream from the convergent section of the second venturi tube.

8. The fuel pump as defined in claim 7 wherein each of the first venturi tube and the second venturi tube comprises a cylindrical throat connecting its respective convergent and divergent section.

9. The fuel pump as defined in claim 7 further comprising a cylindrical passageway disposed in series between the divergent section of the first venturi tube and the convergent section of the second venturi tube.

10. A fuel pump comprising:

a housing including a pump chamber;

an inlet fluidly connected to the pump chamber;

an outlet fluidly connected to the pump chamber;

a one way check valve disposed between the pump chamber and the outlet and oriented to allow fluid flow from the pump chamber to the outlet when the check valve is in an open position;

a first venturi tube fluidly connected in series downstream from the check valve;

a second venturi tube fluidly connected in series downstream from the first venturi tube and upstream of the outlet; and a third venturi tube fluidly positioned upstream from the check valve, wherein the fluid flow from the pump chamber passes in series from the pump chamber, through the third venturi tube, the check valve, the first venturi tube, and the second venturi tube to the outlet, the third venturi tube including a frusto-conical convergent section opening to the pump chamber and connected to a frusto-conical divergent section by a throat, wherein an inlet diameter of the frusto-conical convergent section of the third venturi tube opening to the pump chamber is greater than an outlet diameter of the frusto-conical divergent section of the third venturi tube adjacent to the check valve, wherein the third venturi tube dampens pressure pulsations in the fluid;

an inlet valve movable between an open position in which fluid flow through the inlet and into the pump chamber is permitted, and a closed position in which fluid flow between the inlet and the pump chamber is prevented, the valve having a valve member which cooperates with a valve seat in the housing;

an anchor attached to and linearly movable in unison with the valve member; and an actuator that linearly displaces the valve member and anchor to actuate the valve between the open and the closed positions, wherein:

a surface on the anchor contacts a surface on the core when the valve is in one of the open or closed positions, and the surfaces on the core and the anchor are complementary and conical in shape such that when the surface on the anchor contacts the surface on the core, a conical outer surface on one of the anchor or the core contacts a complimentary conical inner surface on the other of the anchor or the core.

11. The fuel pump as defined in claim 10 wherein each of the first venturi tube and the second venturi tube comprises a convergent section and a divergent section, and wherein the divergent section of the first venturi tube is upstream from the convergent section of the second venturi tube.

12. The fuel pump as defined in claim 11 further comprising a cylindrical passageway disposed in series between the divergent section of the first venturi tube and the convergent section of the second venturi tube.

* * * * *